US006478190B2

(12) United States Patent
Kuge et al.

(10) Patent No.: US 6,478,190 B2
(45) Date of Patent: Nov. 12, 2002

(54) CARTRIDGE AND CARTRIDGE ASSEMBLY FOR FLUID DISPENSING APPARATUS AND METHOD FOR MANUFACTURING THE CARTRIDGE

(75) Inventors: Raizo Kuge, Tokyo-to (JP); Tooru Ichikawa, Tokyo-to (JP)

(73) Assignee: Hosokawa Yoko Co., Ltd., Tokyo (JP)

( * ) Notice: Subject to any disclaimer, the term of this patent is extended or adjusted under 35 U.S.C. 154(b) by 0 days.

(21) Appl. No.: 09/851,137

(22) Filed: May 9, 2001

(65) Prior Publication Data

US 2001/0042757 A1 Nov. 22, 2001

(30) Foreign Application Priority Data

May 19, 2000 (JP) ..... 2000-148365

(51) Int. Cl.[7] ..... B65D 35/28
(52) U.S. Cl. ..... 222/107; 222/95
(58) Field of Search ..... 222/95, 107

(56) References Cited

U.S. PATENT DOCUMENTS 3,604,491 A * 9/1971 Spiess ..... 150/8
3,799,914 A * 3/1974 Schmit et al. ..... 222/107
3,935,993 A * 2/1976 Doyen ..... 229/53
4,353,497 A * 10/1982 Bustin ..... 229/55
5,135,464 A * 8/1992 Buchanan ..... 493/203
5,301,835 A * 4/1994 Fulks et al. ..... 222/95
5,350,240 A * 9/1994 Billman et al. ..... 383/122
5,634,572 A * 6/1997 Lane, Jr. et al. ..... 222/95
6,131,806 A * 10/2000 Hess, III et al. ..... 229/216

* cited by examiner

*Primary Examiner*—Henry C. Yuen
*Assistant Examiner*—Melvin A. Cartagena
(74) *Attorney, Agent, or Firm*—Nixon & Vanderhye

(57) ABSTRACT

A cartridge for a fluid dispensing apparatus, comprises a film shell having a tubular shape; and a film bottom member. The film bottom member is provided at the rear end of the film shell in the longitudinal direction thereof. The film bottom member is capable of being folded into a V-shape along a folding line or of being unfolded so as to expand at the central portion of the folding line in the transverse direction of the film shell, by filling the cartridge with fluid material.

7 Claims, 9 Drawing Sheets

CARTRIDGE AND CARTRIDGE ASSEMBLY FOR FLUID DISPENSING APPARATUS AND METHOD FOR MANUFACTURING THE CARTRIDGE

BACKGROUND OF THE INVENTION

1. Field of the Invention

The present invention relates to (i) a cartridge, which receives therein fluid material such as adhesive, calking agent for constructional purposes, mayonnaise, ketchup or the like and is fitted in a fluid dispensing apparatus, i.e., a fluid dispensing gun for a practical use, (ii) an assembly including such a cartridge and (iii) a method for manufacturing such a cartridge.

2. Description of the Related Art

With respect to such a kind of cartridge for a fluid dispensing apparatus, there has conventionally been known a can-like container made of paper (hereinafter referred to as the "paper can") 1 as shown in FIG. 10. The paper can 1 has a cartridge body 2 having a tubular shape, a nozzle provided at the front end of the cartridge body 2 and a bottom 4 provided at the rear end of the cartridge body 2 so as to be slidable along the inner peripheral surface of the cartridge body 2. FIG. 11 shows a fluid dispensing apparatus 5 in which the paper can 1 is to be placed. The fluid dispensing apparatus 5 is composed of a grip 7, a support member 10, an end plate 8 and a piston 9. The support member 10 has a semi-cylindrical shape and extends forward from the upper end of the grip 7 to support the cartridge, i.e., the paper can 1. The end plate 8 has a horseshoe shape and is provided at the front end of the support member 10. The end plate 8 can come into contact with the discharging end side of the paper can 1. The piston 9 pushes the bottom 4 of the paper can 1 to move it. When the paper can 1 is fitted in the fluid dispensing apparatus 5 and a trigger lever is pulled, a piston disk 6 provided in the fluid dispensing apparatus 5 pushes the bottom 4. As a result, fluid material such as adhesive or the like with which the paper can 1 is filled, is squeezed from the nozzle 3.

The cartridge body 2 of the paper can 1 has a high rigidity. The paper can 1 in which fluid material received in it has been used up is subjected to disposal as waste without collapsing it. This may lead to an enormous waste amount of paper cans 1, causing social problems of waste disposal. In order to solve such problems, there has conventionally been proposed a cartridge for a fluid dispensing apparatus as shown in FIG. 12, having a sausage-shape, which can be squeezed by the piston disk 6 to decrease the volume of the cartridge. The cartridge 13 for a fluid dispensing apparatus is formed of a plastic film into a film shell 13*a* having a tubular shape. The front and rear ends of the film shell 13*a* are closed by means of fasteners 13*b*, 13*b* such as relatively heavy metallic wires. The cartridge 13 with the front end portion near the fastener 13*b* cut is fitted in the fluid dispensing apparatus 5 in practical use and the piston disk squeezes the rear end of the cartridge 13. When such a sausage-shaped cartridge 13 for a fluid dispensing apparatus is used, a fluid dispensing apparatus having a nozzle is applied as the fluid dispensing apparatus 5.

There is known a cartridge assembly for a fluid dispensing apparatus as shown in FIG. 13, in which the volume of a cartridge can be decreased through a squeezing operation (see Japanese Laid-Open Patent Application No. H7-1711, 461). The cartridge assembly is composed of a cartridge 19 and an outer tube 18. The cartridge 19 is provided with a film shell 15 having a tubular shape and molded portions 16, 17 provided at the opposite ends of the film shell 15, respectively. Formation of the molded portions 16, 17 is carried out by an injection molding method. The outer tube 18 has a tubular shape and can receive the cartridge 19 in it. In such a cartridge 19, the film shell 15 is formed into a tubular shape, and then, the molded portions 16, 17 are provided at the opposite ends of the film shell 15 by carrying out an insert injection forming method or joining pre-formed parts to the opposite ends of the film shell 15. The molded portion 16 at the front end of the film shell 15 has a discharging opening 16*a* from which fluid material can be discharged. A nozzle (not shown) may be screwed to the discharging opening 16*a*. The cartridge assembly 14 is fitted in a fluid dispensing apparatus when used. The piston disk pushes the molded portion 17 locating at the rear end of the film shell 15 so that the molded portion 17 slides in the outer tube 18. As a result, the cartridge 19 is squeezed. The outer tube 18 can be used repeatedly.

However, in the conventional sausage-shaped cartridge 13 as shown in FIG. 12 for a fluid dispensing apparatus, the cartridge 13 does not have a sufficient strength and deep wrinkles occur at both the front and rear ends of the film shell 13*a* when fluid material is squeezed from the cartridge 13, which has been fitted in the fluid dispensing apparatus. A relatively large amount of fluid material is left between the deep wrinkles, thus causing a problem. The excessively deep wrinkles may cause clogging of the nozzle of the fluid dispensing apparatus.

In the conventional cartridge assembly as shown in FIG. 13 for a fluid dispensing apparatus, the molded portions 16, 17 has a sufficient strength, but the film shell 15 does not have a sufficient strength and deep wrinkles occur on the film shell 15 as shown in FIG. 14. A relatively large amount of fluid material is left in a gap P between the deep wrinkles, thus causing a problem. The molded portions 16, 17 forms the opposite ends of the cartridge 19. Consequently, even when the film shell 15 is collapsed, the volume of each of the molded portions 16, 17 remains unchanged, leading to limitation of the total volume of the collapsed cartridge 19. In addition, two steps, i.e., the formation step for the film shell 15 and the molding step for the molded portions 16, 17 are required, leading to complicated manufacture of the cartridge assembly.

SUMMARY OF THE INVENTION

An object of the present invention is therefore to provide a cartridge for a fluid dispensing apparatus, which can be formed only of a film without carrying out a molding method and prevent any deep wrinkles from occurring when squeezed by means of the fluid dispensing apparatus, a cartridge assembly including such a cartridge and a method for manufacturing such a cartridge.

In order to attain the aforementioned object, in a cartridge of the present invention for a fluid dispensing apparatus, a film bottom member folded into a V-shape is provided at the rear end of a film shell having a tubular shape. More specifically, the cartridge of the present invention comprises: a film shell having a tubular shape; and a film bottom member provided at a rear end of said film shell in a longitudinal direction thereof, said film bottom member being capable of being folded into a V-shape along a folding line or of being unfolded so as to expand at a central portion of said folding line in a transverse direction of said film shell, by filling said cartridge with fluid material.

According to the present invention described above, it is possible to manufacture the cartridge for a fluid dispensing apparatus only with the use of a film without carrying out a molding method. As a result, a lamination structure may be applied to the cartridge and incorporation of a film having for example an excellent barrier property into the lamination structure makes it possible to apply the cartridge to storage of foods to be received. The film bottom member, which forms the rear end of the cartridge for a fluid dispensing apparatus, can be folded into a V-shape or unfolded so as to expand at the central portion of the folding line in the transverse direction of the film shell, thus increasing the strength of the bottom. This makes it possible to prevent deep wrinkles from occurring on the bottom of the cartridge for a fluid dispensing apparatus. In addition, the strength of the rear end portion of the cartridge can also be increased, thus providing an appropriate seating state of a piston disk of the fluid dispensing apparatus against the rear end of the cartridge.

The above-mentioned film shell may have a joint portion, which is formed by joining opposite side edges of a rectangular flat film to each other, said joint portion extending from the rear end of said film shell to a front end thereof in the longitudinal direction of said film shell. According to such an optional feature of the present invention, the joint portion serves as a strut for the film shell, thus increasing the strength of the film shell. It is therefore possible to prevent deep wrinkles from occurring on the film shell when squeezing the cartridge for a fluid dispensing apparatus.

The above-mentioned joint portion may pass through a place corresponding to the central portion of said folding line of said film bottom member. According to such an optional feature of the present invention, the joint portion serving as the strut increases the strength of the film shell in balance.

In order to attain the aforementioned object, the other cartridge of the present invention for a fluid dispensing apparatus, comprises a film shell having a tubular shape; and a nozzle provided at a front end of said film shell in the longitudinal direction thereof, said nozzle being formed by sealing said front end of said film shell to provide a nozzle member, and then cutting a tip end of said nozzle member. According to such a feature of the present invention, it is possible to manufacture the cartridge for a fluid dispensing apparatus only with the use of a film without carrying out a molding method. The nozzle provided at the front end of the film shell prevents deep wrinkles from occurring on the front end of the film shell when squeezing the cartridge.

In order to attain the aforementioned object, a cartridge assembly of the present invention for a fluid dispensing apparatus, comprises: a cartridge for a fluid dispensing apparatus, comprising (i) a film shell having a tubular shape, said film shell having a joint portion, which is formed by joining opposite side edges of a rectangular flat film to each other, said joint portion extending from a rear end of said film shell to a front end thereof in the longitudinal direction of said film shell; (ii) a film bottom member provided at the rear end of said film shell in a longitudinal direction thereof, said film bottom member being capable of being folded into a V-shape along a folding line or of being unfolded so as to expand at a central portion of said folding line in a transverse direction of said film shell, by filling said cartridge with fluid material and (iii) a nozzle provided at the front end of said film shell, said nozzle being formed by sealing said front end of said film shell to provide a nozzle member, and then cutting a tip end of said nozzle member; an outer tube having a tubular shape, into which said cartridge for the fluid dispensing apparatus can be received; a pushing member, which is placed slidably in said outer tube to squeeze said cartridge for the fluid dispensing apparatus; and an outer frame nozzle, which is provided at a front end of said outer tube to support said nozzle of said cartridge for the fluid dispensing apparatus.

According to such features of the present invention, the pushing member, which is slidable in the outer tube, pushes the cartridge received in the outer tube to squeeze the cartridge, thus making it possible to carry out a stable pushing operation for the cartridge so as to prevent the cartridge from partially swelling up. The outer frame nozzle supports the nozzle of the cartridge for a fluid dispensing apparatus, thus preventing an unfavorable movement of the nozzle when the contents in the cartridge are discharged.

In order to attain the aforementioned object, a method for manufacturing a cartridge for a fluid dispensing apparatus, which comprises the steps of: joining opposite side edges of a rectangular flat film to each other to form a film shell having a tubular shape; placing a film bottom member at a rear end of said film shell in a longitudinal direction thereof, said film bottom member being capable of being folded into a V-shape along a folding line or of being unfolded so as to expand at a central portion of said folding line in a transverse direction of said film shell, by filling said cartridge with fluid material; and sealing a front end of said film shell in the longitudinal direction thereof to provide a nozzle member, and then cutting a tip end of said nozzle member so as to form a nozzle.

According to such features of the present invention, it is possible to manufacture the cartridge for a fluid dispensing apparatus only with the use of a film without carrying out a molding method. It is also possible to prevent deep wrinkles from occurring on the film shell, the film bottom member and the nozzle during discharge of the contents.

DETAILED DESCRIPTION OF THE PREFERRED EMBODIMENTS

Now, embodiments of a cartridge of the present invention for a fluid dispensing apparatus will be described in detail below with reference to the accompanying drawings.

Figure 1:
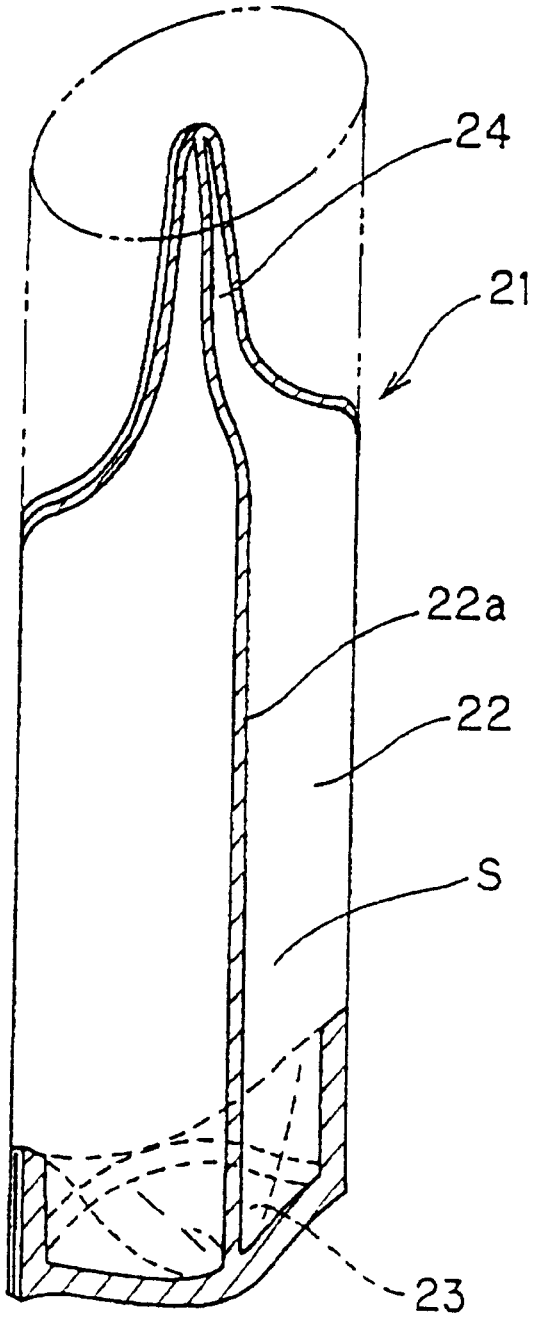
FIG. 1 is a perspective view illustrating a cartridge of the embodiment of the present invention for a fluid dispensing apparatus.
Figure 2A:
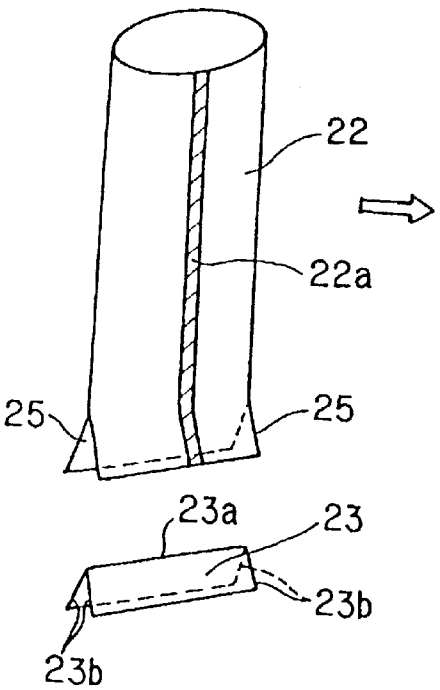
FIGS. 2(*a*), 2(*b*), 2(*c*) and 2(*d*) are views illustrating the steps for manufacturing the cartridge as shown in FIG. 1.
Figure 2B:
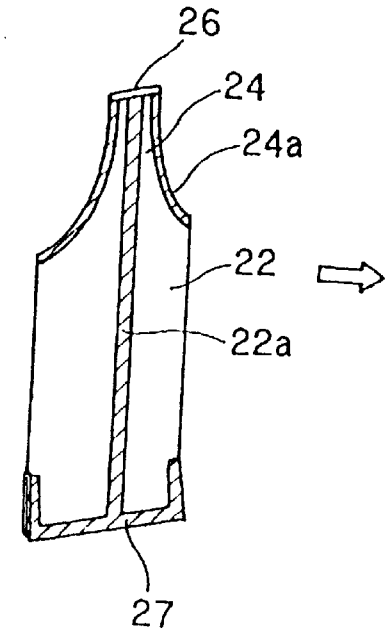
Figure 2C:
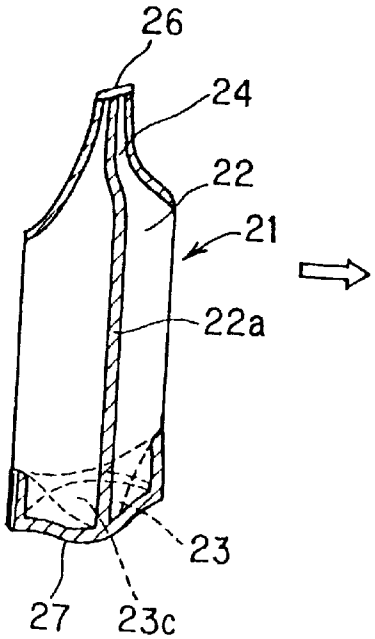
Figure 2D:
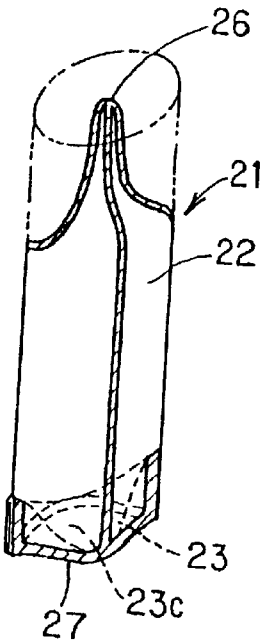

FIG. 1 shows a cartridge 21 of the first embodiment of the present invention for a fluid dispensing apparatus. The cartridge 21 for the fluid dispensing apparatus is composed of a film shell 22 having a tubular shape, a film bottom member 23 and a nozzle 24. The film bottom member 23 is provided at the rear end (i.e., the lower end) of the film shell 22. The film bottom member 23 can be folded into a V-shape along a folding line or unfolded so as to expand at the central portion of the folding line in the transverse direction of the film shell 22, by filling the cartridge 21 with fluid material. The nozzle 24 is provided at the front end (i.e., the upper end) of the film shell 22 in the longitudinal direction thereof. The film shell 22 and the film bottom member 23 form a space S, which is to be filled with fluid material. The fluid material with which the space S is to be filled, may include for example adhesive, calking agent for constructional purposes, mayonnaise, ketchup or the like.

Description will be given below of a method for manufacturing the cartridge 21 for a fluid dispensing apparatus, by which the components of the cartridge 21 can be easily understood. FIGS. 2(*a*), 2(*b*), 2(*c*) and 2(*d*) are views illustrating the steps for manufacturing the cartridge 21 for a fluid dispensing apparatus. First, the opposite side edges of a rectangular flat film are joined to each other to form the film shell 22 having the tubular shape. A fusion-bonding method is applied to the opposite side edges of the flat film to form a joint portion 22*a* in the film shell 22. The joint portion 22*a* extends from the rear end of the film shell 22 to the front end thereof in the longitudinal direction. Cutouts 25, are formed on the opposite sides of the lower portion of the film shell 22 having the tubular shape.

In addition to the film shell 22, there is prepared the film bottom member 23, which has been folded into a V-shape along the folding line 23*a* (see FIG. 2(*a*)). Then, the film bottom member 23 kept upside down is fitted into the cutouts 25, 25 of the film shell 22. In the embodiment of the present invention, the two cutouts 25, 25 are formed in the film shell 22. The film bottom member 23 may however be inserted into the lower portion of the film shell 22 without forming such cutouts.

Then, the opposite lower edges of the film shell 22 are fusion-bonded to the corresponding portions of the film bottom member 23, and the respective facing portions near the respective cutouts 25, 25 and the corresponding portions of the film bottom member 23 are fusion-bonded to each other (see FIG. 2(*b*)). The resultant fusion-bonded portion 27 is shown in hatching in FIG. 2(*b*). The joint portion 22*a* passes through a place corresponding to the central portion of the folding line 23*a* of the film bottom member 23 to extend in the longitudinal direction of the film shell 22.

Figure 3:
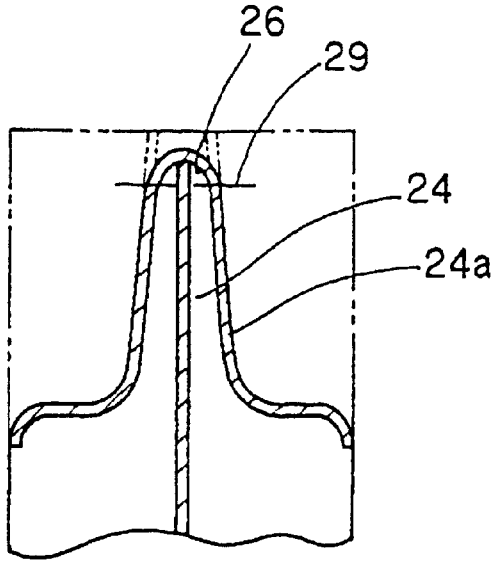
FIG. 3 is a partial plan view of the cartridge as shown in FIG. 1.

Then, the front end of the film shell 22 is fusion-bonded to form a tapered nozzle member. The tip end of the tapered nozzle member is cut out to form a nozzle 24 (see FIG. 2(*c*)). The nozzle 24 is provided at its tip end with a mouth 26 through which fluid material can be inserted into the cartridge 21 during carrying out a subsequent step. FIG. 3 is a plan view of the nozzle 24. In the step for forming the nozzle 24, there is prepared a heating plate (not shown), which has the corresponding shape to the shape of the nozzle 24. The film shell 22 is deformed in a flat state and the heating plate is pressed against the film shell 22 so as to form a fusion-bonded portion 24*a,* which has the corresponding shape to the nozzle 24 in a sealing width of about 3 mm.

Figure 4:
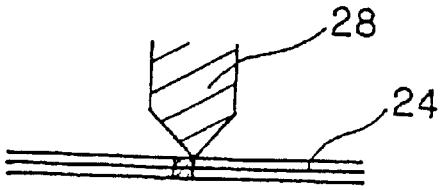
FIG. 4 is a schematic cross-sectional view illustrating a fusion cutting and sealing step.

The cutting step is carried out to cut the film shell 22 along the fusion-bonded portion 24*a* corresponding to the shape of the nozzle 24 so as to form the nozzle 24. FIG. 4 shows the other step for forming the nozzle 24, i.e., the fusion cutting and sealing step. In such a fusion cutting and sealing step, the heating plate 28 also has a function of cutting the film shell 22 so that the fusion-bonding and the cutting can simultaneously be carried out. When the nozzle 24 is formed through such a fusion cutting and sealing step, it is possible to decrease the sealing width of the fusion-bonded portion 24*a* of the nozzle 24 as small as possible.

Then, the cartridge 21 is filled with fluid material from the mouth 26 of the nozzle 24 as shown in FIG. 2(*c*). The lower portion of the film shell 22 and the film bottom member 23 are kept in a flat state prior to supply of fluid material into the cartridge 21. The film bottom member 23 expands at the central portion 23*c* in the transverse direction of the film shell 22 after the cartridge 21 is filled with fluid material (see FIG. 2(*c*)). The fusion-bonded portion 27 has rigidity given thereto, which is higher than that of the other portion, thus providing an appropriate shape of the cartridge 21 after fluid material is filled into the cartridge 21.

Then, the mouth 26 of the nozzle 24 is closed by a fusion-bonding method (see FIG. 2(*d*)). The mouth 26 is provided at its edge with a portion 29 to be cut to open the mouth 26 so as to discharge fluid material from it (see FIG. 3). The portion 29 to be cut may have a printed line such as a dotted line or a broken line so that the portion 29 can be cut along such a printed line by means of a pair of scissors. The portion 29 to be cut may be formed by a notch, a perforated line, a half-cut line or the like alone or in combination so as to be tearable by fingers. More specifically, there may be adopted a structure in which the notch is provided at the starting point of the portion 29 to be cut and the perforated line or the half-cut line is provided so as to be connected to the notch. The cartridge 21 for a fluid dispensing apparatus can be manufactured by carrying out the above-described steps.

Figure 5A:
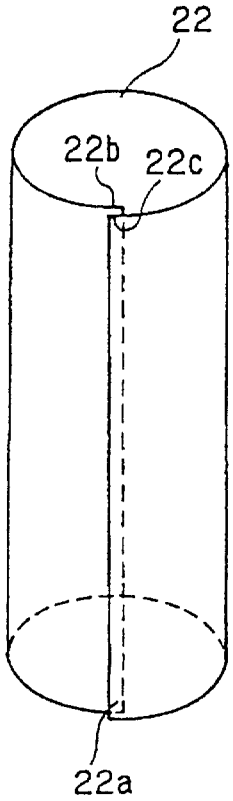
FIGS. 5(*a*), 5(*b*) and 5(*c*) are views illustrating examples of a film shell having a tubular shape, and more specifically, FIG. 5(*a*) illustrates the first example in which the inner surface of the one side edge of the rectangular film is joined to the outer surface of the other side edge thereof, FIG. 5(*b*) illustrates the second example in which the opposite side edges of the rectangular film butt each other and the butt portions are joined to each other by a joint tape and FIG. 5(*c*) illustrates the third example in which the inner surface of the one side edge of the rectangular film is joined to the same inner surface of the other side edge thereof.
Figure 5B:
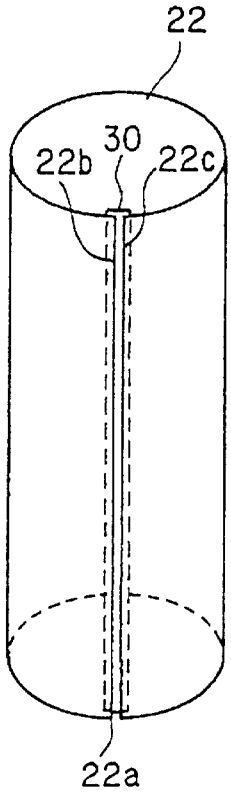
Figure 5C:
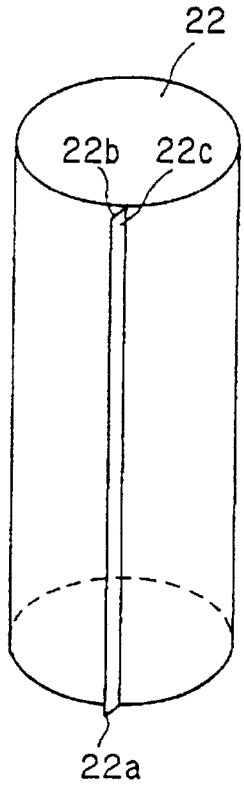
Figure 6A:
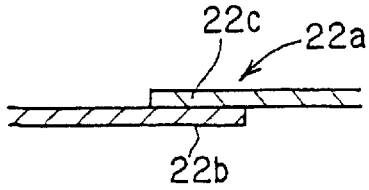
FIGS. 6(*a*), 6(*b*), 6(*c*) and 6(*d*) are views illustrating examples of the joint portion, and more specifically, FIG. 6(*a*) illustrates the first example in which the inner surface of the one side edge of the rectangular film is joined to the outer surface of the other side edge thereof, FIG. 6(*b*) illustrates the second example in which the opposite side edges of the rectangular film butt each other and the butt portions are joined to each other by a flat joint tape, FIG. 6(*c*) illustrates the third example in which the opposite side edges of the rectangular film butt each other and the butt portions are joined to each other by a joint tape having a crank shape in cross section and FIG. 6(*d*) illustrates the fourth example the inner surface of the one side edge of the rectangular film is joined to the same inner surface of the other side edge thereof.
Figure 6B:
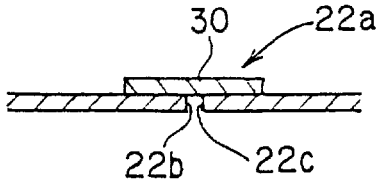
Figure 6C:
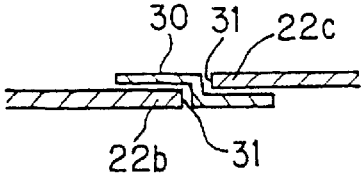
Figure 6D:
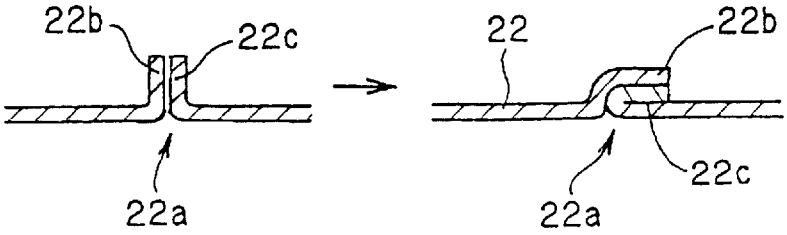

FIGS. 5(*a*), 5(*b*) and 5(*c*) illustrate examples of the film shell 22 having the tubular shape prior to insertion of the film bottom member 23. The film shell 22 as shown in FIG. 5(*a*) is a so-called envelope type in which the inner surface of the one side edge 22*b* of the film shell is placed on the outer surface of the other side edge 22*c* thereof by a prescribed amount of overlapping and these side edges 22*b*, 22*c* are joined to each other by means of a joining means such as adhesive, fusion-bonding or the like. The film shell 22 as shown in FIG. 5(*b*) is a so-called joint tape-type in which the opposite side edges 22*b*, 22*c* of the rectangular film butt each other and the but portions are joined to each other by means of a joining means such as a joint tape or the like. The film shell 22 as shown in FIG. 5(*c*) is a so-called principal rafter-type in which the inner surface of the one side edge 22*b* of the rectangular film is placed on the same inner surface of the other side edge 22*c* thereof by a prescribed amount of overlapping and these side edges 22*b*, 22*c* are joined to each other by means of the joining means such as adhesive, fusion-bonding or the like.

FIGS. 6(*a*), 6(*b*), 6(*c*) and 6(*d*) are views illustrating examples of the joint portion, and more specifically, FIG. 6(*a*) illustrates the first example in which the inner surface of the one side edge of the rectangular film is joined to the outer surface of the other side edge thereof, FIG. 6(*b*) illustrates the second example in which the opposite side edges of the rectangular film butt each other and the butt portions are joined to each other by a flat joint tape, FIG. 6(*c*) illustrates the third example in which the opposite side edges of the rectangular film butt each other and the butt portions are joined to each other by a joint tape having a crank shape in cross section and FIG. 6(*d*) illustrates the fourth example the inner surface of the one side edge of the rectangular film is joined to the same inner surface of the other side edge thereof. The third example as shown in FIG. 6(*c*) is adapted to use in case where contents received in the cartridge are corrosive material such as acid. The end surfaces 31, 31 of the side edges 22*b*, 22*b* of the film shell 22 are covered with the joint tape, i.e., the sealing member 30 so as to prevent the end surfaces 31, 31 from being damaged by the acid. In the forth example as shown in FIG. 6(*d*), the inner surface of the one side edge of the rectangular film for the film shell 22 is placed on the inner surface the other side edge thereof to fusion bond them to each other, and then the joined portion is bent to one side so as to come into contact with the adjacent portion of the film shell 22 to fusion-bond the former to the latter. It is therefore possible to improve remarkably reinforcement of the joint portion 22*a*, thus increasing the strength of the joint portion 22*a* serving as the strut.

Figure 7A:
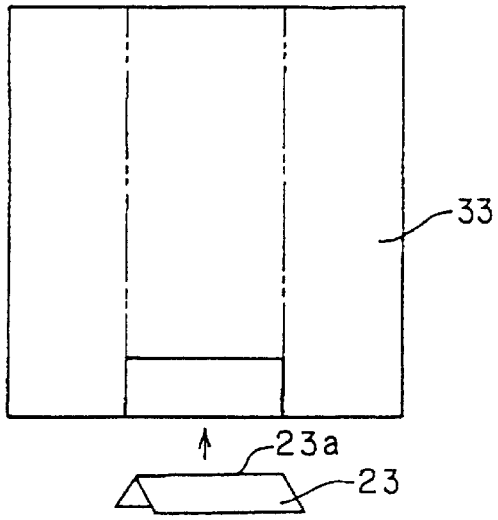
FIGS. 7(*a*) and 7(*b*) are views illustrating the other steps for manufacturing the cartridge for a fluid dispensing apparatus.
Figure 7B:
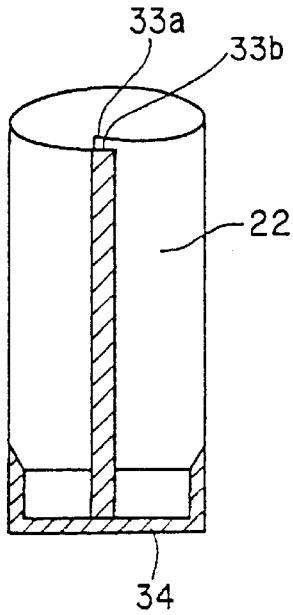

FIGS. 7(*a*) and 7(*b*) illustrate the other steps for manufacturing the cartridge for a fluid dispensing apparatus. A film bottom member 23 is folded in two to form a folding line 23*a* so as to prepare a V-shaped film bottom member 23. The V-shaped film bottom member 23 is oriented so that the folding line 23*a* is directed upward, and placed on the lower portion of the rectangular flat film 33 (see FIG. 7(*a*)). The film bottom member 23 is temporarily secured to the rectangular flat film 33 by means of a joining means such as adhesive, fusion-bonding or the like. Then, the inner surface of the one side edge portion of the rectangular flat film 33 is placed on the outer surface of the other side edge portion thereof by a prescribed width to fusion-bond the former to the latter. The film shell 22 having the tubular shape is prepared in this manner. Then, the lower peripheral portion of the film shell 22 is fusion-bonded to the opposite lower portions of the film bottom member 23. In addition, the opposite side edge portions of the film bottom member 23 are also fusion-bonded to the film shell 22 (see FIG. 7(*b*)). The resultant fusion-bonded portions 34 are shown in FIG. 7(*b*). The subsequent steps are identical to those of the above-mentioned manufacturing method and description of them is omitted. According to such a manufacturing method, it is possible to provide the film bottom member 23 at the lower portion of the film shell 22 without forming any cutout in the lower portion of the film shell 22, thus leading to an easy manufacture of the cartridge 21 for a fluid dispensing apparatus.

With respect to material for forming the film shell 22 and the film bottom member 23 of which the cartridge 21 for a fluid dispensing apparatus is composed, there may be used resin such as polyester, nylon, polypropylene, polyethylene and the like. A laminate comprising at least two sheets formed of resin selected from the above-mentioned group.

Description of an example of the laminate will be given below. The laminate can provide a transparent cartridge 21 for a fluid dispensing apparatus.

[1] The laminate for the so-called envelope type film shell is composed of (i) a non-oriented polypropylene (CPP) layer having a thickness of 50 μm, (ii) an adhesive layer for a dry laminate (DL), (iii) a biaxial oriented polyester (PET) layer or a biaxial oriented nylon layer having a thickness of 12 μm, (iv) a printing layer, (v) an adhesive layer for a dry laminate (DL), (vi) a non-oriented polypropylene (CPP) layer having a thickness of 50 μm or a straight chain type-low density polyethylene (L-LDPE) layer having a thickness of 50 μm, (vii) an adhesive layer for a dry laminate (DL), (viii) a biaxial oriented polyester (PET) layer or a biaxial oriented nylon layer having a thickness of 12 μm, (ix) a printing layer, (x) an adhesive layer for a dry laminate (DL) and (xi) a straight chain type-low density polyethylene (L-LDPE) layer having a thickness of 50 μm.

[2] The laminate for the so-called joint tape-type film shell is composed of (i) a biaxial oriented polyester (PET) layer or a biaxial oriented nylon layer having a thickness of 12 μm, (ii) a printing layer, (iii) an adhesive layer for a dry laminate (DL) and (iv) a non-oriented polypropylene (CPP) layer having a thickness of 80 μm. In this case, the joint tape is composed of a non-oriented polypropylene (CPP) layer having a thickness of 20 μm, (ii) an adhesive layer for a dry laminate (DL), (iii) a biaxial oriented polyester (PET) layer or a biaxial oriented nylon layer having a thickness of 12 μm and (iv) a non-oriented polypropylene (CPP) layer having a thickness of 20 μm.

Now, description will be given below of an example of the laminate in which an aluminum film is used as a lamination layer so that the cartridge 21 for a fluid dispensing apparatus becomes opaque.

[1] The laminate for the so-called envelope type film shell is composed of (i) a non-oriented polypropylene (CPP) layer having a thickness of 40 μm, (ii) an adhesive layer for a dry laminate (DL), (iii) a biaxial oriented polyester (PET) layer or a biaxial oriented nylon layer having a thickness of 15 μm, (iv) a printing layer, (v) an adhesive layer for a dry laminate (DL), (vi) an aluminum foil (AL) layer having a thickness of 7 μm, (vii) an adhesive layer for a dry laminate (DL), (viii) a non-oriented polypropylene (CPP) layer having a thickness of 40 μm or a straight chain type-low density polyethylene (L-LDPE) layer having a thickness of 40 μm, (ix) an adhesive layer for a dry laminate (DL), (x) a biaxial oriented polyester (PET) layer having a thickness of 12 μm or a biaxial oriented nylon layer having a thickness of 15 μm, (xi) a printing layer, (xii) an adhesive layer for a dry laminate (DL), (xiii) an aluminum foil (AL) layer having a thickness of 7 μm, (xiv) an adhesive layer for a dry laminate (DL) and (xv) a straight chain type-low density polyethylene (L-LDPE) layer having a thickness of 40 m.

[2] The laminate for the so-called joint tape-type film shell is composed of (i) a biaxial oriented polyester (PET) layer or a biaxial oriented nylon layer having a thickness of 12 μm, (ii) a printing layer, (iii) an adhesive layer for a dry laminate (DL), (iv) an aluminum foil (AL) layer having a thickness of 7 μm, (v) an adhesive layer for a dry laminate (DL) and (vi) a non-oriented polypropylene (CPP) layer having a thickness of 70 μm. In this case, the joint tape is composed of a non-oriented polypropylene (CPP) layer having a thickness of 20 μm, (ii) an adhesive layer for a dry laminate (DL), (iii) a biaxial oriented polyester (PET) layer having a thickness of 12 μm, (iv) an adhesive layer for a dry laminate (DL) and (v) a non-oriented polypropylene (CPP) layer having a thickness of 20 μm.

As the laminate for the film bottom member 23, one of the followings having the total thickness of from 50 μm to 140 μm:

[1] the laminate composed of (i) a non-oriented polypropylene (CPP) layer, (ii) an adhesive layer for a dry laminate (DL), (iii) a biaxial oriented polyester (PET) layer or a biaxial oriented nylon layer, (iv) an adhesive layer for a dry laminate (DL) and (v) a non-oriented polypropylene (CPP) layer having a thickness of 50 μm;

[2] the laminate composed of (i) a straight chain type-low density polyethylene (L-LDPE) layer, (ii) an adhesive layer for a dry laminate (DL), (iii) a biaxial oriented polyester (PET) layer or a biaxial oriented nylon layer, (iv) an adhesive layer for a dry laminate (DL) and (v) a straight chain type-low density polyethylene (L-LDPE) layer;

[3] the laminate composed of (i) a biaxial oriented polyester (PET) layer, (ii) an adhesive layer for a dry laminate (DL) and (iii) a straight chain type-low density polyethylene (L-LDPE) layer;

[4] the laminate composed of (i) a non-oriented nylon (ON) film, (ii) an adhesive layer for a dry laminate (DL) and (iii) a straight chain type-low density polyethylene (L-LDPE) layer; and

[5] the aluminum foil-containing type laminate composed of (i) a non-oriented polypropylene (CPP) layer, (ii) an adhesive layer for a dry laminate (DL), (iii) a biaxial oriented polyester (PET) layer or a biaxial oriented nylon layer, (iv) an adhesive layer for a dry laminate (DL), (v) an aluminum foil (AL) layer, (vi) an adhesive layer for a dry laminate (DL) and a non-oriented polypropylene (CPP) layer.

The cartridge 21 for the fluid dispensing apparatus is composed of the film shell 22 having the tubular shape, the film bottom member 23 and the nozzle 24 as shown in FIG. 1. The film bottom member 23 is provided at the rear end of the film shell 22. The film bottom member 23 can be folded into a V-shape along the folding line or unfolded so as to expand at the central portion of the folding line in the transverse direction of the film shell 22, by filling the cartridge 21 with fluid material. The nozzle 24 is provided at the front end (i.e., the upper end) of the film shell 22 in the longitudinal direction thereof. It is possible to manufacture the cartridge for a fluid dispensing apparatus only with the use of the film without carrying out a molding method, as mentioned above. As a result, a lamination structure may be applied to the cartridge and incorporation of the film having for example an excellent barrier property into the lamination structure makes it possible to apply the cartridge to storage of foods to be received. The film bottom member, which forms the rear end of the cartridge 21 for a fluid dispensing apparatus, can be folded into the V-shape or unfolded so as to expand at the central portion of the folding line in the transverse direction of the film shell, thus increasing the strength of the bottom. This makes it possible to prevent deep wrinkles from occurring on the bottom of the cartridge for a fluid dispensing apparatus. In addition, the strength of the rear end portion of the cartridge can also be increased, thus providing an appropriate seating state of a piston disk of the fluid dispensing apparatus against the rear end of the cartridge. Further, the joint portion 22*a* serves as a strut for the film shell 22, thus increasing the strength of the film shell 22. It is therefore possible to prevent deep wrinkles from occurring on the film shell 22 when squeezing the cartridge for a fluid dispensing apparatus. The nozzle 24 provided at the front end of the film shell 22 prevents deep wrinkles from occurring on the front end of the film shell 22 when squeezing the cartridge.

Figure 8:
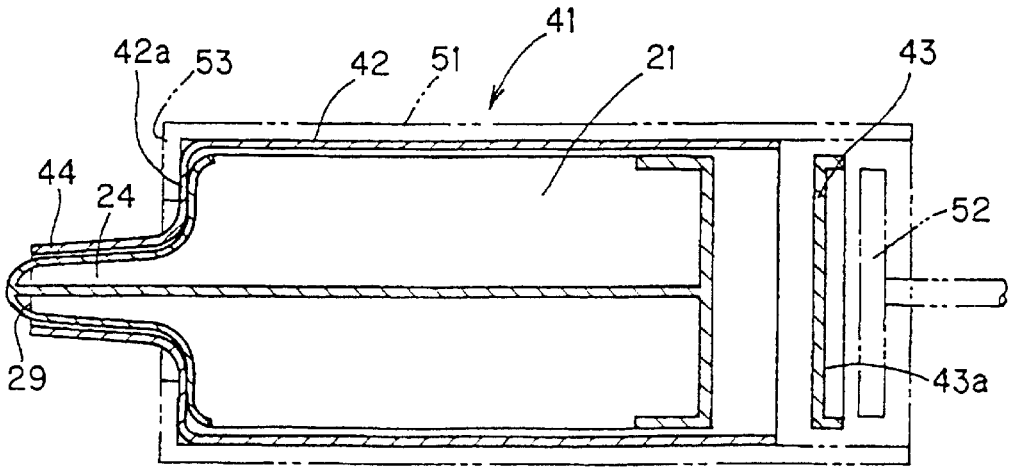
FIG. 8 is a cross-sectional view illustrating a cartridge assembly of the embodiment of the present invention for a fluid dispensing apparatus.

FIG. 8 shows a cartridge assembly 41 for a fluid dispensing apparatus. The cartridge assembly 41 for a fluid dispensing apparatus is composed of the cartridge 21 described above, an outer tube 42, a pushing member 43 and an outer frame nozzle 44. The outer tube 42 has as tubular shape, into which the cartridge 21 for the fluid dispensing apparatus can be received. The pushing member 43 is placed slidably in the outer tube 42 to squeeze the cartridge 21. The outer frame nozzle 44 is provided at the front end of the outer tube 42 to support the nozzle of the cartridge 21. The outer tube 42 is mounted on the support member 51 of the fluid dispensing apparatus, which has a semi-cylindrical shape. The outer tube 42 has a shoulder portion 42*a,* which comes into contact with the end plate 53 having a horseshoe shape. The pushing member 43 has a recess portion 43a into which the piston disk 52 of the fluid dispensing apparatus can put. The pushing member 43 has an outer diameter, which is slightly smaller than the inner diameter of the outer tube 42. The outer nozzle 4 restrains the nozzle 24 of the cartridge 21 from moving in an improper manner. A set of the outer tube 42 and the pushing member 43 may be attached to a plurality of products, for example of ten cartridges 21 for sale. The outer tube 42 and the pushing member 43 are formed of resin. The outer nozzle 44 may have a detachable cap, as an occasion demands.

After the outer nozzle 42 receives the cartridge 21, the portion 29 of the cartridge 21 is cut. When the trigger lever of the fluid dispensing apparatus is pulled, the pushing member 43 slides in the outer tube 42 under the function of the piston disk 52. The cartridge 21 received in the outer tube 42 is squeezed to discharge fluid material such as adhesive filled in the cartridge 21 from the nozzle 24. The cartridge 21 is squeezed in the outer tube 42, thus preventing the cartridge 21 from partially swelling up. The outer frame nozzle 44 supports the nozzle 24 of the cartridge 21 for a fluid dispensing apparatus, thus preventing an unfavorable movement of the nozzle 24 when the contents in the cartridge 21 are discharged. When the fluid material received in the cartridge 21 is used up, the cartridge 21 is exchanged for a new cartridge. The outer tube 42 and the pushing member 43 can however be used repeatedly.

Figure 9:
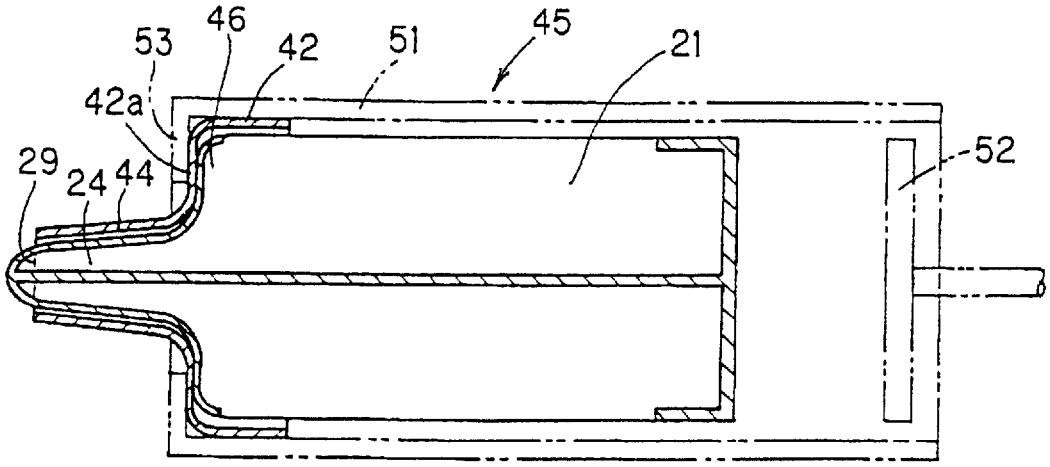
FIG. 9 is a cross-sectional view illustrating a cartridge assembly of the other embodiment of the present invention for a fluid dispensing apparatus.
Figure 10:
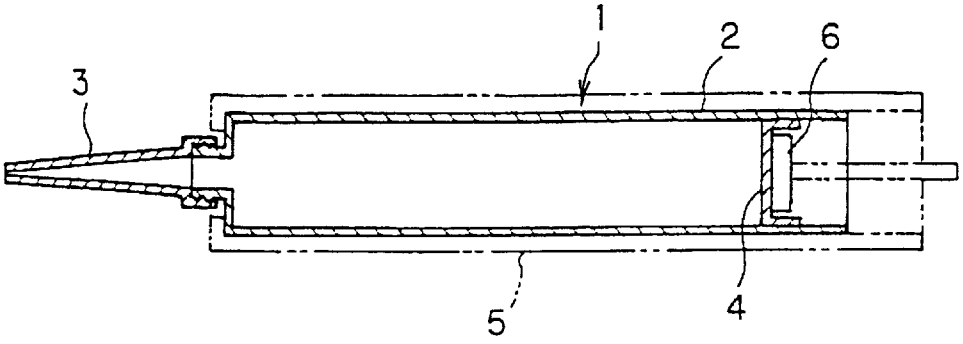
FIG. 10 PRIOR ART
FIG. 10 is a cross-sectional view illustrating the conventional paper can.
Figure 11:
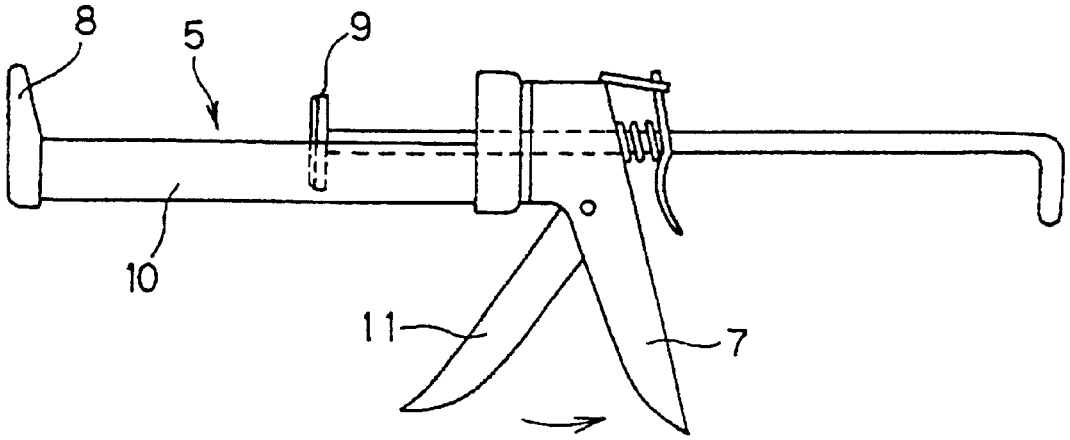
FIG. 11 PRIOR ART
FIG. 11 is a side view illustrating the conventional fluid dispensing apparatus.
Figure 12:
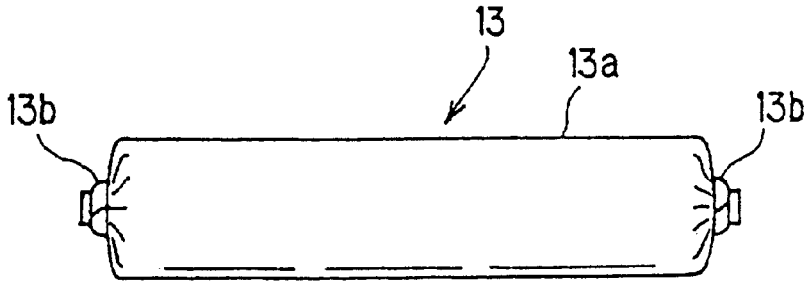
FIG. 12 PRIOR ART
FIG. 12 is s side view illustrating the conventional sausage-shaped cartridge for a fluid dispensing apparatus.
Figure 13:
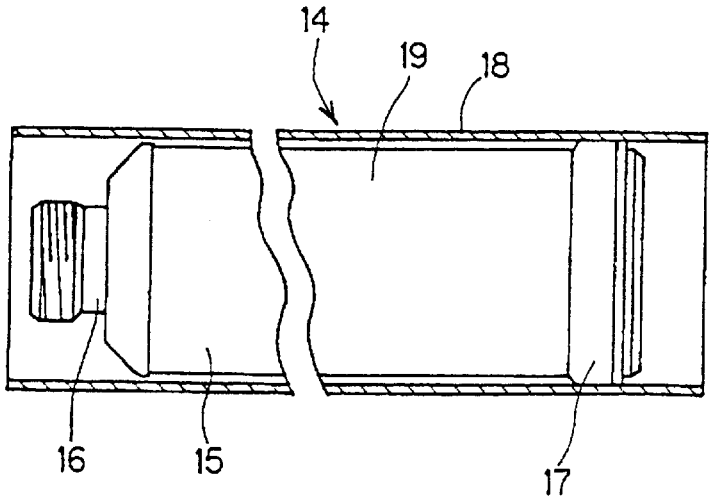
FIG. 13 PRIOR ART
FIG. 13 is a side view illustrating the conventionally injection-molded cartridge for a fluid dispensing apparatus, which includes the partial cross-sectional view of an outer tube.
Figure 14:
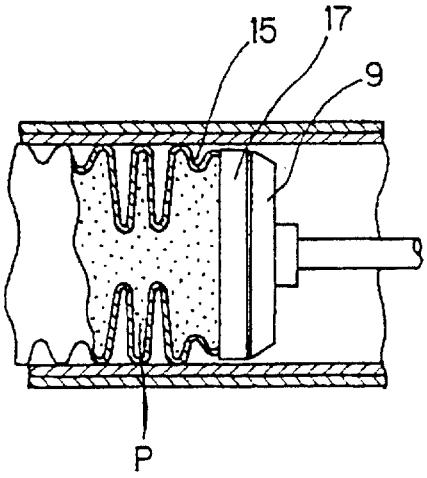
FIG. 14 PRIOR ART
FIG. 14 is a cross-sectional view illustrating occurrence of wrinkles on the conventionally injection-molded cartridge for a fluid dispensing apparatus.

FIG. 9 shows the cartridge assembly of the other embodiment of the present invention. In the cartridge assembly 45, the outer tube 42 covers only the shoulder portion 46 of the cartridge 21 without entirely extending from the front end to the rear end of the cartridge 21, unlike the above-described cartridge assembly. The outer tube 42 is provided at the front end with an outer frame nozzle 44 for supporting the nozzle 24 of the cartridge 21. The cartridge 21 is directly pressed not by the pushing member, but by the piston disk 52 of the fluid dispensing apparatus. In the cartridge assembly of the other embodiment of the present invention, it is also possible to squeeze fluid material such as adhesive received in the cartridge 21, from the nozzle 24.

According to the present invention as described in detail, the cartridge for a fluid dispensing apparatus comprises: a film shell having a tubular shape; and a film bottom member provided at a rear end of said film shell in a longitudinal direction thereof, said film bottom member being capable of being folded into a V-shape along a folding line or of being unfolded so as to expand at a central portion of said folding line in a transverse direction of said film shell, by filling said cartridge with fluid material. It is therefore possible to manufacture the cartridge for a fluid dispensing apparatus only with the use of a film without carrying out a molding method. As a result, a lamination structure may be applied to the cartridge and incorporation of a film having for example an excellent barrier property into the lamination structure makes it possible to apply the cartridge to storage of foods to be received. The film bottom member, which forms the rear end of the cartridge for a fluid dispensing apparatus, can be folded into a V-shape or unfolded so as to expand at the central portion of the folding line in the transverse direction of the film shell, thus increasing the strength of the bottom. This makes it possible to prevent deep wrinkles from occurring on the bottom of the cartridge for a fluid dispensing apparatus.

What is claimed is:

1. A cartridge for a fluid dispensing apparatus, which comprises:

a film shell having a front end and a rear end in a longitudinal direction of said film shell, said film shell having a joint portion extending in the longitudinal direction of said film shell, said joint portion being formed by joining opposite side edges of a rectangular flat film to each other so as to provide a tubular shape, said joint portion being placed in a center in a lateral direction of said film shell, said film shell being provided at said front end with a tapered-sealed portion and at said rear end with an opening, said tapered-sealed portion being placed in the center in the lateral direction of said film shell so that said joint portion extends to a tip of said tapered-sealed portion; and a film bottom member provided at the rear end of said film shell to close said opening, said film bottom member being capable of being folded into a V-shape along a folding line or of being unfolded so as to expand at a central portion of said folding line in a transverse direction of said film shell, by filling said cartridge with fluid material.

2. The cartridge as claimed in claim 1, wherein said tapered-sealed portion serves as a nozzle.

3. The cartridge as claimed in claim 1, wherein said film shell is formed from a single piece of film and said joint portion forms the sole joint extending between said tapered seal portion at said front end and the opening at said rear end.

4. A cartridge assembly for a fluid dispensing apparatus, which comprises:

a cartridge for a fluid dispensing apparatus, comprising (i) a film shell having a front end and a rear end in a longitudinal direction of said film shell, said film shell having a joint portion extending in the longitudinal direction of said film shell, said joint portion being formed by joining opposite side edges of a rectangular flat film to each other so as to provide a tubular shape, said joint portion being placed in a center in a lateral direction of said film shell, said film shell being provided at said front end with a tapered-sealed portion and at said rear end with an opening, said tapered-sealed portion being placed in the center in the lateral direction of said film shell so that said joint portion extends to a tip of said tapered-sealed portion; and (ii) a film bottom member provided at the rear end of said film shell to close said opening, said film bottom member being capable of being folded into a V-shape along a folding line or of being unfolded so as to expand at a central portion of said folding line in a transverse direction of said film shell, by filling said cartridge with fluid material;

an outer tube having a tubular shape, into which said cartridge for the fluid dispensing apparatus can be received;

a pushing member, which is placed slidably in said outer tube to squeeze said cartridge for the fluid dispensing apparatus; and an outer frame nozzle, which is provided at a front end of said outer tube to support said nozzle of said cartridge for the fluid dispensing apparatus.

5. The cartridge as claimed in claim 4, wherein said tapered-sealed portion serves as a nozzle.

6. The cartridge as claimed in claim 4, wherein said film shell is formed from a single piece of film and said joint portion forms the sole joint extending between said tapered seal portion at said front end and the opening at said rear end.

7. A method for manufacturing a cartridge for a fluid dispensing apparatus, which comprises the steps of:

joining opposite side edges of a rectangular flat film to each other to form a film shell having a tubular shape, said film shell having a joint portion extending in a longitudinal direction of said film shell and being placed in a center in a lateral direction of said film shell;

placing a film bottom member at a rear end of said film shell in the longitudinal direction thereof, said film bottom member being capable of being folded into a V-shape along a folding line or of being unfolded so as to expand at a central portion of said folding line in a transverse direction of said film shell, by filling said cartridge with fluid material; and sealing a front end of said film shell in the longitudinal direction thereof to form tapered-sealed portion, said tapered-sealed portion being placed in the center in the lateral direction of said film shell so that said joint portion extends to a tip of said tapered-sealed portion.

* * * * *